US007325592B2

(12) United States Patent
Cristante et al.

(10) Patent No.: US 7,325,592 B2
(45) Date of Patent: Feb. 5, 2008

(54) COOLING ASSEMBLY FOR VEHICLES

(75) Inventors: Luigi Cristante, Poirino (IT); Marco Carpentino, Poirino (IT)

(73) Assignee: Denso Thermal Systems, S.p.A., Poirino (Torino) (IT)

( * ) Notice: Subject to any disclaimer, the term of this patent is extended or adjusted under 35 U.S.C. 154(b) by 29 days.

(21) Appl. No.: 11/339,944

(22) Filed: Jan. 26, 2006

(65) Prior Publication Data

US 2006/0169442 A1 Aug. 3, 2006

(30) Foreign Application Priority Data

Jan. 28, 2005 (EP) ..... 05425036

(51) Int. Cl.
*F01P 5/02* (2006.01)

(52) U.S. Cl. ..... 165/121; 180/68.1

(58) Field of Classification Search ..... 165/41, 165/67, 121, 140; 180/68.1, 68.4
See application file for complete search history.

(56) References Cited

U.S. PATENT DOCUMENTS

| | | | | |
|---|---|---|---|---|
| 4,685,513 | A * | 8/1987 | Longhouse et al. | 165/121 |
| 4,955,434 | A * | 9/1990 | Price | 165/122 |
| 5,522,457 | A * | 6/1996 | Lenz | 165/121 |
| 5,875,836 | A * | 3/1999 | Nakamura | 165/122 |
| 6,315,034 | B1 * | 11/2001 | Mahe et al. | 165/121 |
| 6,615,604 | B2 * | 9/2003 | Neufang | 62/298 |
| 6,682,319 | B2 * | 1/2004 | Kobayashi | 417/360 |
| 7,044,203 | B2 * | 5/2006 | Yagi et al. | 165/122 |
| 2006/0207815 | A1 * | 9/2006 | Vandekerkhof | 180/68.4 |

FOREIGN PATENT DOCUMENTS

| | | |
|---|---|---|
| EP | 0 970 833 | 1/2000 |
| EP | 1 424 533 | 6/2004 |
| FR | 2 699 961 | 7/1994 |
| FR | 2 779 221 | 12/1999 |
| FR | 2 794 170 | 12/2000 |
| JP | 10 16543 | 1/1998 |
| KR | 2004096715 A * | 11/2004 |

OTHER PUBLICATIONS

European Search Report dated Aug. 1, 2005 from EP Application No. 05425036.0.

* cited by examiner

*Primary Examiner*—Allen J. Flanigan
(74) *Attorney, Agent, or Firm*—Patterson & Sheridan, LLP

(57) ABSTRACT

Cooling assembly for vehicles, comprising a radiator including two collecting tanks made of plastic material, an element fastened to the radiator, and fastening means for the mutual fastening of the element and of the radiator, including two U-shaped seats on each of said collecting tanks and two pairs of engagement members fastened to said element. Each of said engagement members comprises a pivot formation with a cylindrical outer surface having circular section and each of said seats has an elastically deformable snap-on engagement surface having semi-cylindrical shape with circular section able to receive said pivot formation in snap-on engagement.

11 Claims, 8 Drawing Sheets

COOLING ASSEMBLY FOR VEHICLES

CROSS-REFERENCE TO RELATED APPLICATIONS

The present application is based on, and claims priority from, European Application Serial Number 05425036.0, filed Jan. 28, 2005, the disclosure of which is hereby incorporated by reference herein in its entirety.

BACKGROUND OF THE INVENTION

The present invention relates to a cooling assembly for vehicle according to the preamble of claim 1, which is known from the document FR-A-2699961.

The document FR-2699961 describes a cooling assembly for an internal combustion engine of a vehicle, comprising a support of a fan provided with fastening members for fastening to the collecting tanks of a radiator. The collecting tanks are equipped with U-shaped integral seats which receive the ends of support arms of the fan. Also provided are elastically deformable tabs which engage in snap-on fashion portions of the engagement members outside the U-shaped seats, to prevent the disengagement of the support of the fan from the respective seat. The fastening organs are constituted by the free ends of first arms which extend towards the collecting tanks. The solution described in this document further requires second arms directed orthogonally to the first arms to engage two sides of the radiator, orthogonal to the collecting tanks.

SUMMARY OF THE INVENTION

The object of the present invention is to provide a simpler solution for fastening an element to a radiator, in particular one that does not require the use of second arms for the engagement of the sides of the radiator, orthogonal relative to the collecting tanks.

According to the present invention, said object is achieved by a cooling assembly having the characteristics set out in claim 1.

BRIEF DESCRIPTION OF THE DRAWINGS

The characteristics and the advantages of the present invention shall become readily apparent in the detailed description that follows, provided purely by way of non limiting example, with reference to the accompanying drawings, in which.

DETAILED DESCRIPTION OF THE INVENTION

Figure 1:
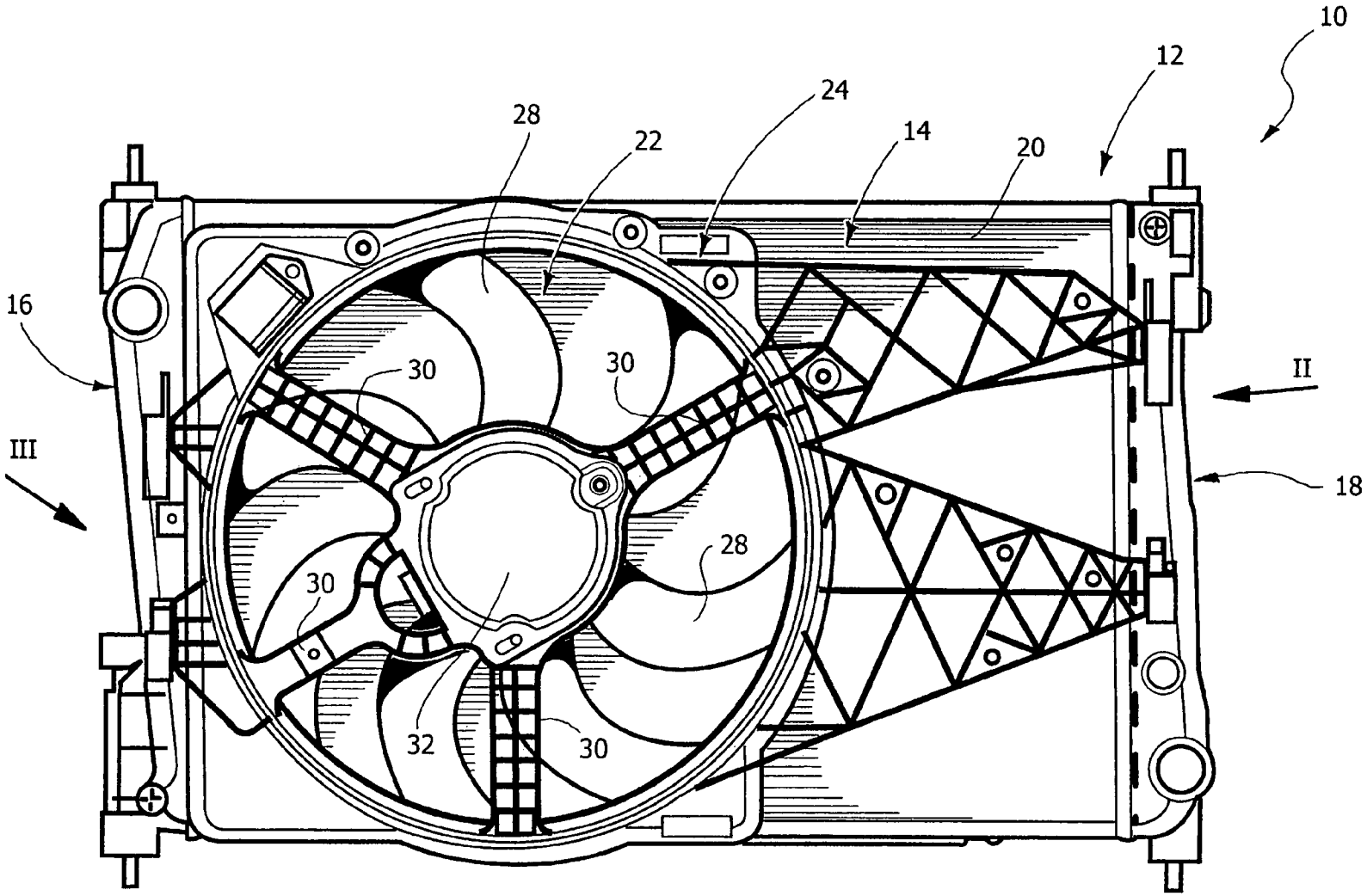
FIG. 1 is a front elevation view of a first embodiment of a cooling assembly according to the present invention.

With reference to FIG. 1, the reference number 10 designates a cooling assembly for vehicles, comprising a radiator 12 and a ventilation unit 14.

The radiator 12 comprises two collecting tanks 16, 18 made of injection moulded plastic material and a tube and fin heat exchange core 20 positioned between the tanks 16, 18. The ventilation unit 14 comprises at least one fan 22 and a support structure 24 constituted by a monolithic element made of injection moulded plastic material.

The support structure 24 comprises a circular wall 26 which constitutes a housing for the fan 28. Four arms 30 extend radially outwards starting from the circular wall 26 and bear a central support 32 whereto is fastened the electric motor.

The support structure 24 could be provided with two adjacent circular walls 26, each of which is associated to a respective fan.

Both in the version with a single fan, and in the version with two fans, the support structure 24 comprises four integral fastening arms 34 which extend laterally outwards. Each arm 34 has at its outer end an engagement member 36 constituted by a pivot formation with an outer surface of cylindrical shape obtained in integral form at the end of the respective arm 34.

With reference to FIGS. 2 through 5, each collecting tank 16, 18 of the radiator 12 is provided with two seats 38 each of which receives a respective engagement organ 36. Each seat 38 is constituted by injection moulded plastic material and it is obtained in integral form with the respective collecting tank 16, 18.

Figure 2:
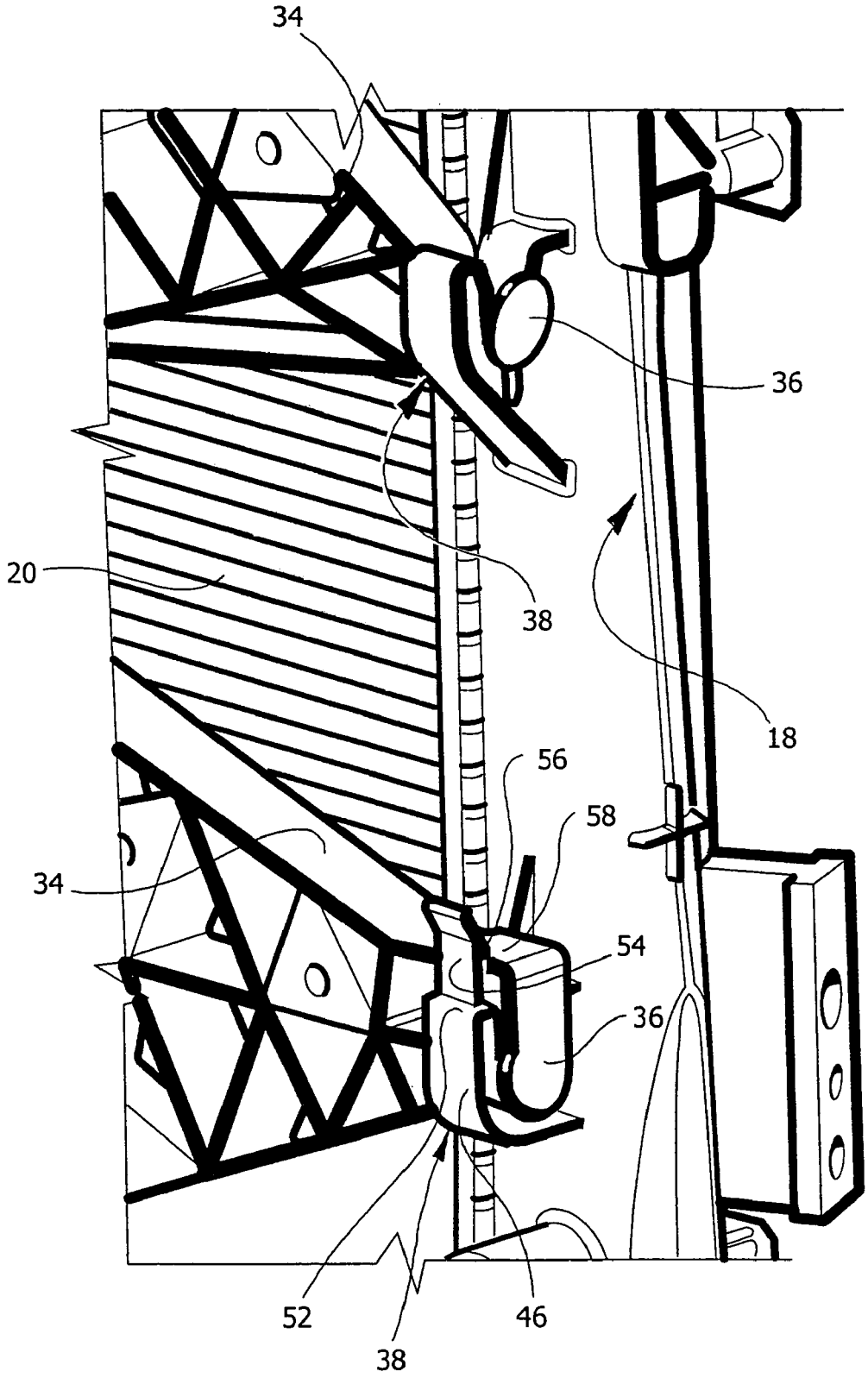
FIGS. 2 and 3 are perspective views in enlarged scale of the parts indicated by the arrows II and III in FIG. 1.
Figure 3:
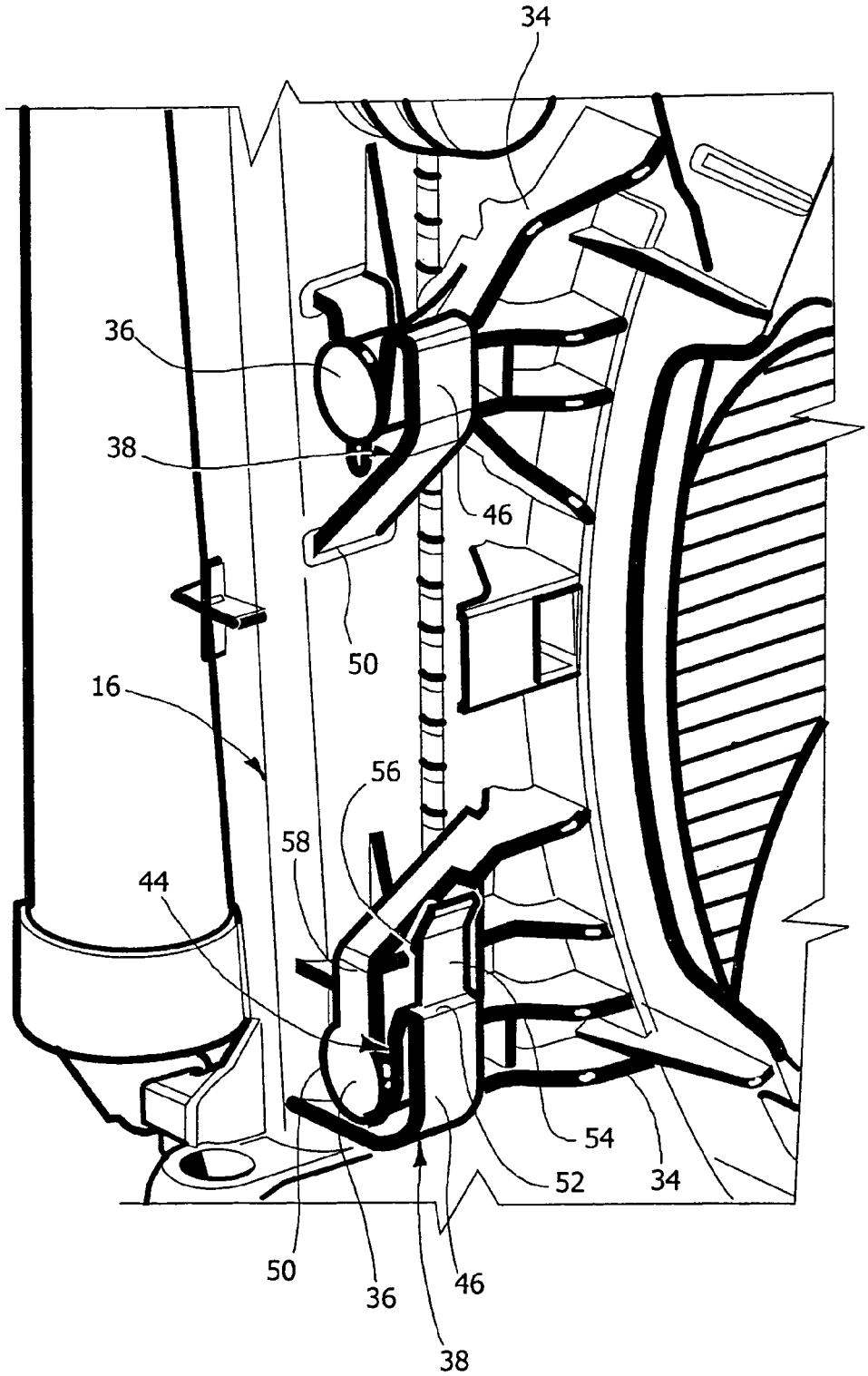
Figure 4:
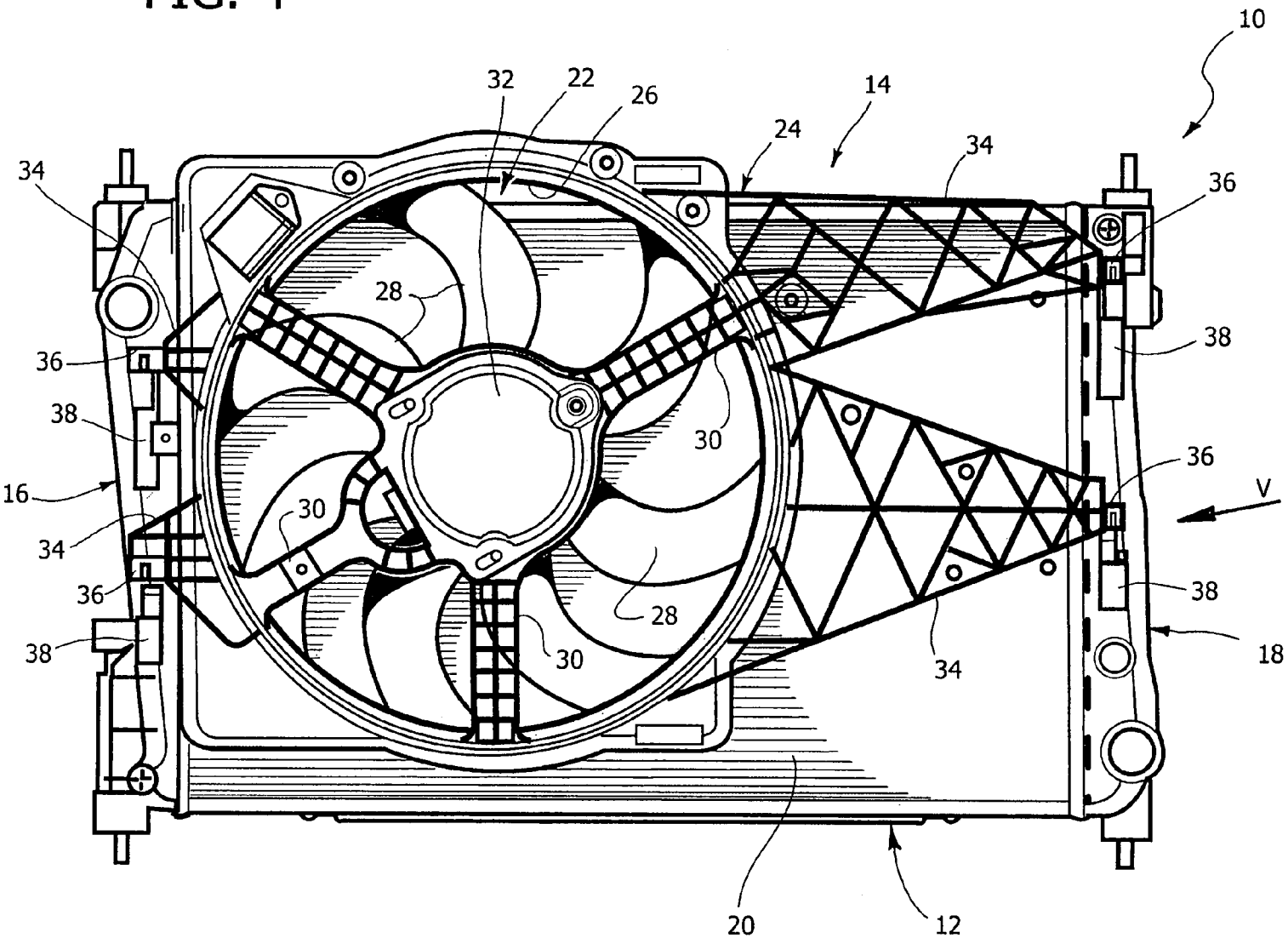
FIG. 4 is a front elevation view which illustrates the way in which the support of the fan is fastened to the radiator.
Figure 5:
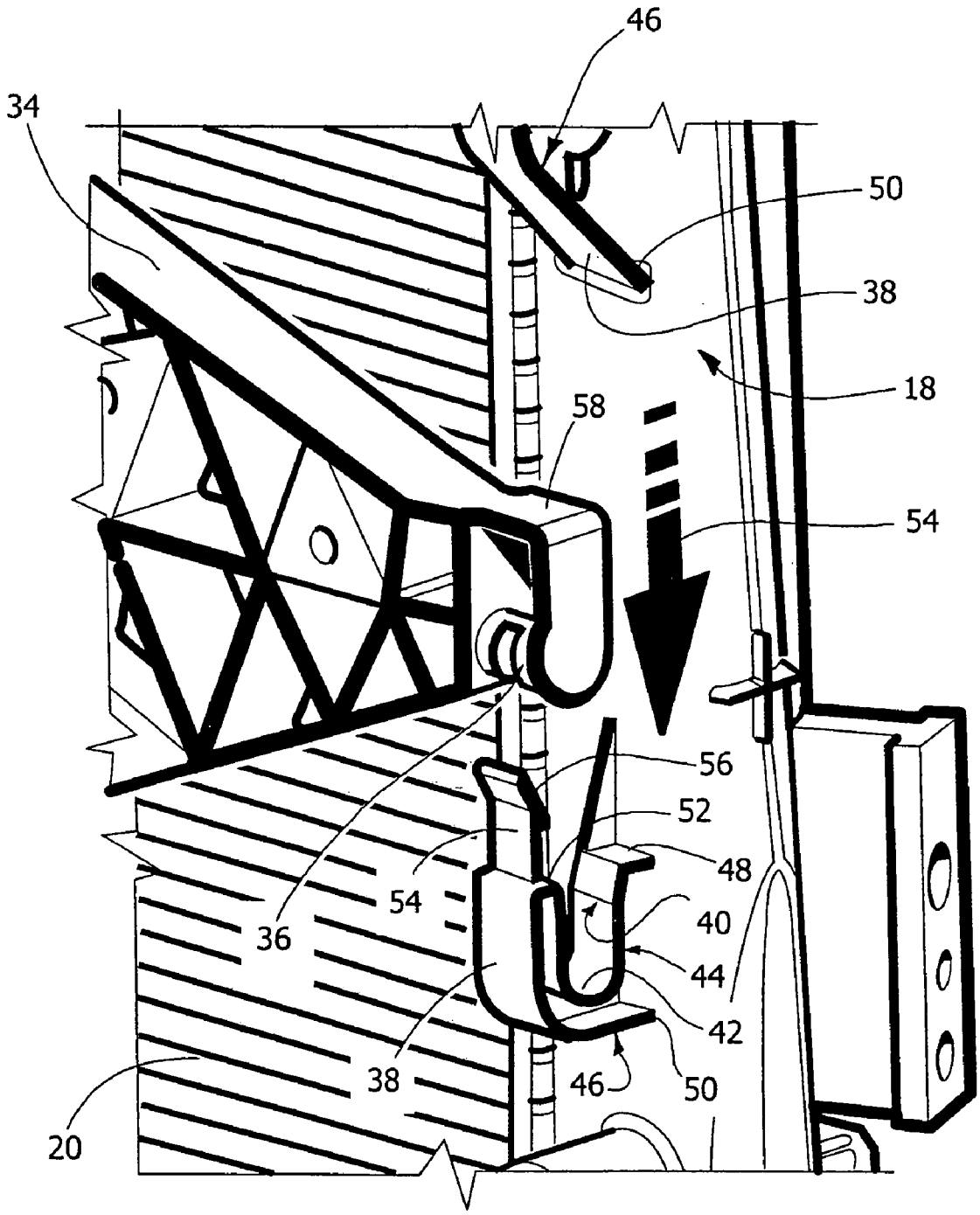
FIG. 5 is an enlarged scale detail of the part indicated by the arrow V in FIG. 4.

With reference to FIGS. 2, 3 and 5, each seat 38 has a U-shaped inner surface 40 with an engagement portion 42 of semi-cylindrical shape with circular section with such dimensions as to establish a snap-on engagement with the outer surface of the pivot formation 36.

Each seat 38 is formed by a thin wall of plastic material projecting from the flank of the respective collecting tank 16, 18. The thin wall forming the seat 18 comprises a first U-shaped branch 44 bearing the inner surface 40 with the snap-on engagement surface 42, and a substantially L-shaped second branch 46 joined to an end of the first branch 44. The first and the second branch 44, 46 have respective proximal ends 48, 50 that are fixed relative to the flank of the respective collecting tank 16, 18 and respective distal ends mutually joined by a junction portion 52. The two branches 44, 46 are mutually distanced in such a way as to form an empty gap between the outer surface of the first branch 44 and the inner surface of the second branch 46.

The described shape for the seats 38 allows to obtain an elastic deformability of the engagement surface 42, which is therefore able to establish a snap-on coupling with the cylindrical surface 36 of the pivot shaped engagement member. Preferably, the snap-on engagement surface 42 has an angular extension that is slightly greater than 180° and the radius of curvature of the circular engagement surface 42 is substantially equal to the radius of the outer surface of the engagement member 36. The greater than 180° angular extension of the curved surface 42 causes the pivot formation 36 to have to elastically deform the first branch 44 before engaging the surface 42 when it is inserted in the seat 38 with the movement in the direction indicated by the arrow 54 in FIG. 5.

The snap-on engagement between the surface 42 of each seat 38 and the pivot formation 36 is sufficient to assure a stable connection, without play, of the support structure of the fan 24 to the radiator 12. To provide assurance against accidental disengagement, on each of the lower seats 38 of the collecting tanks 16, 18 is preferably provided an elastically deformable tab 54. The tab 54 projects from the junction portion 52 between the first branch 44 and the second branch 46 of the seat 38. The tab 54 is formed integrally with the two branches 44, 46 (in turn integral to each other and integral with the body of the respective collecting tank 16, 17). The elastically deformable tab 54 has an engagement tooth 56 which engages in snap-on fashion a planar surface 58 of the end portion of the respective arm 34 and provides a detent against the disengagement of the pivot formation 36 of the snap-on engagement surface 42.

In the embodiment illustrated in FIGS. 1 through 5, the four seats 38 provided on the two collecting tanks 16, 18 are all oriented in the same direction, in the specific case with the U-shaped surface oriented upwards. In this case, the support structure of the fan 24 is mounted on the radiator with a downwards movement (see in particular FIGS. 4 and 5). As a result of this movement, the pivot formations 36 are inserted in, and engage in snap-on fashion the respective circular surfaces 42 and the elastically deformable tabs 54 engage in snap-on fashion the respective surfaces 58. The snap-on connection between the pivots 36 and the surfaces 42 excludes the existence of play on the mutual connection surfaces. Therefore, the relative fastening between the support structure of the fan 24 and the radiator 12 is particular secure and effective and does not require the further connection points along the sides of the radiator that are orthogonal to the collecting tanks 16, 18.

Figure 6:
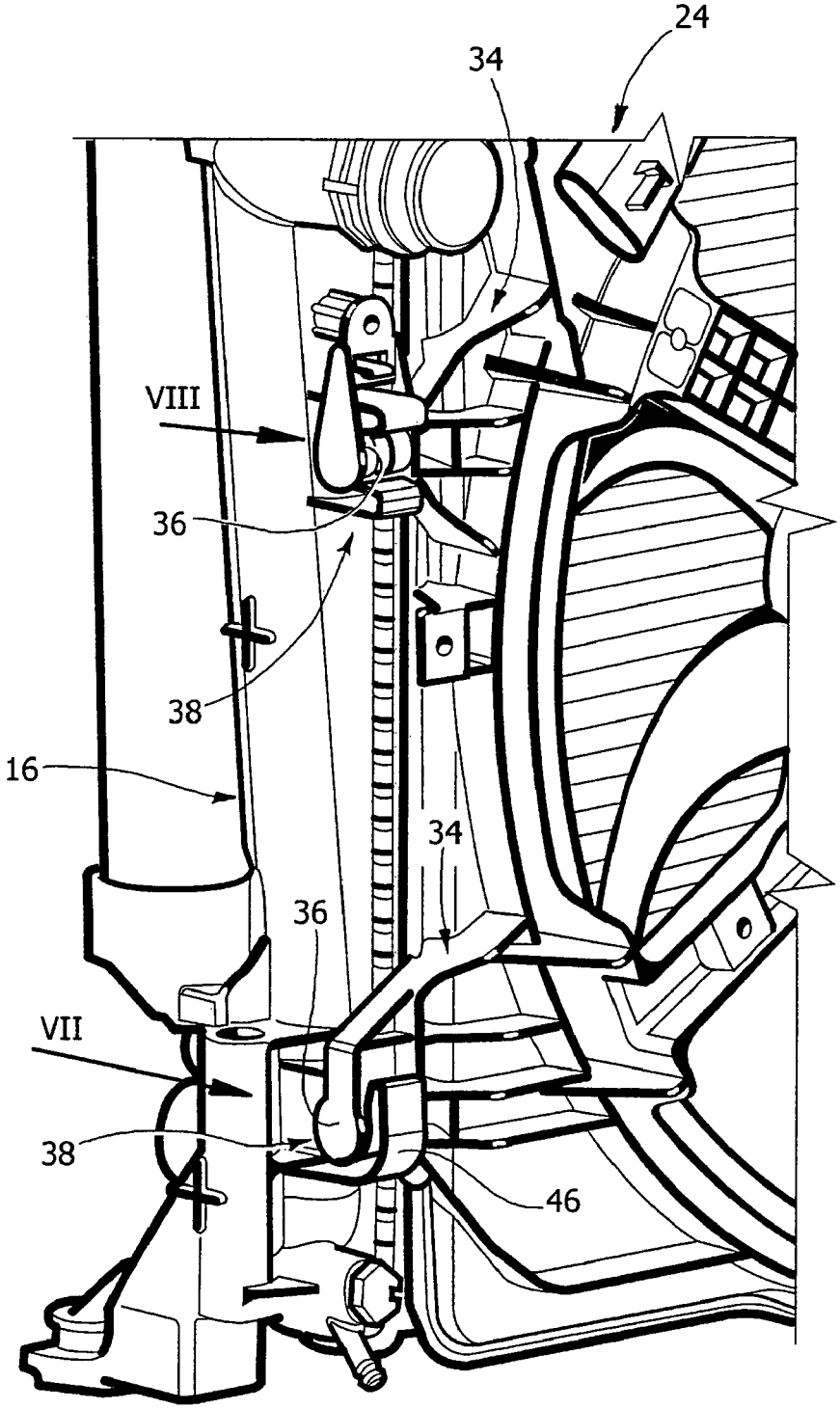
FIG. 6 is a perspective view corresponding to FIG. 3 showing a second embodiment of the present invention.
Figure 7:
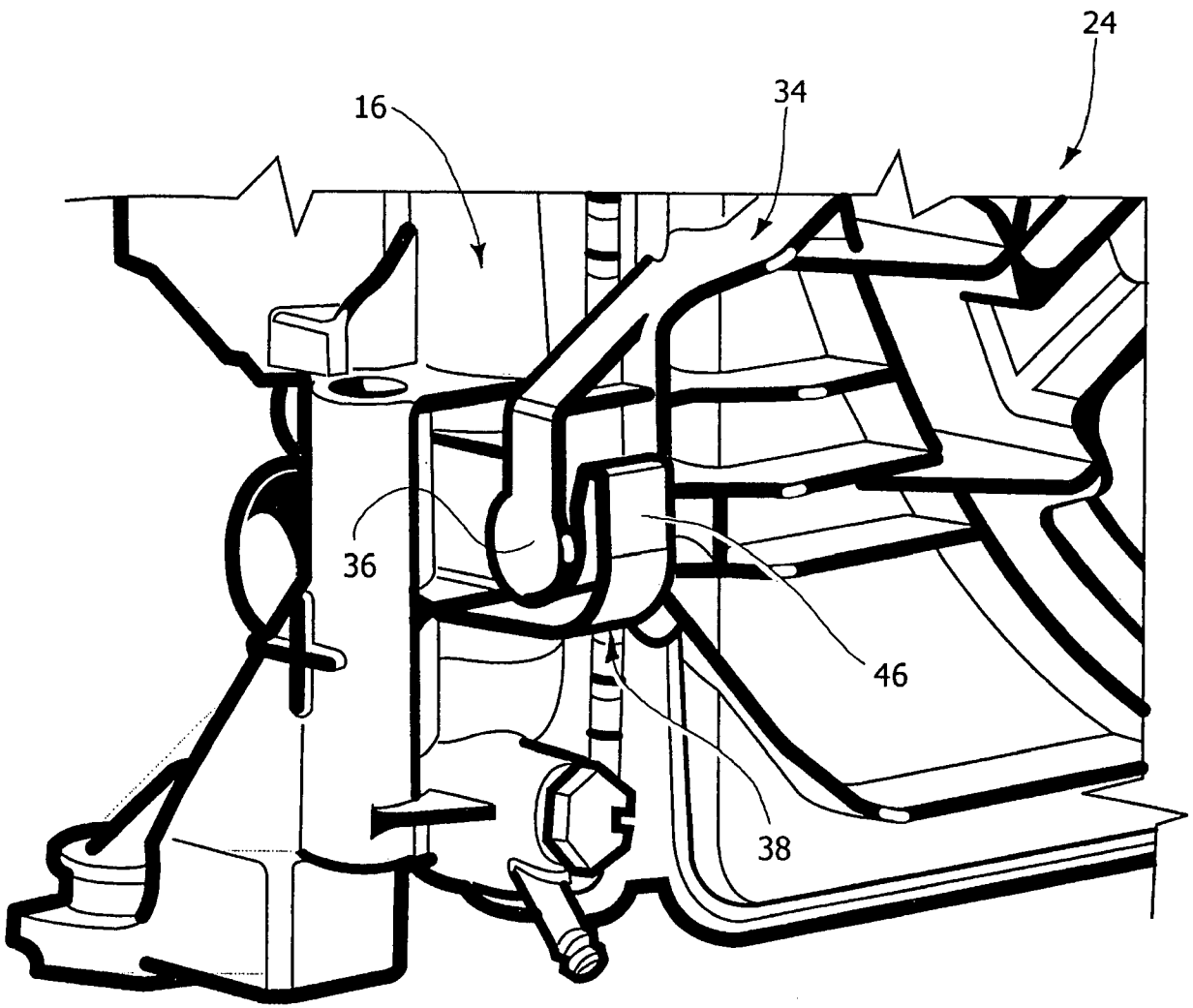
FIGS. 7 and 8 are perspective views of the parts indicated by the arrows VII and VII in FIG. 6.
Figure 8:
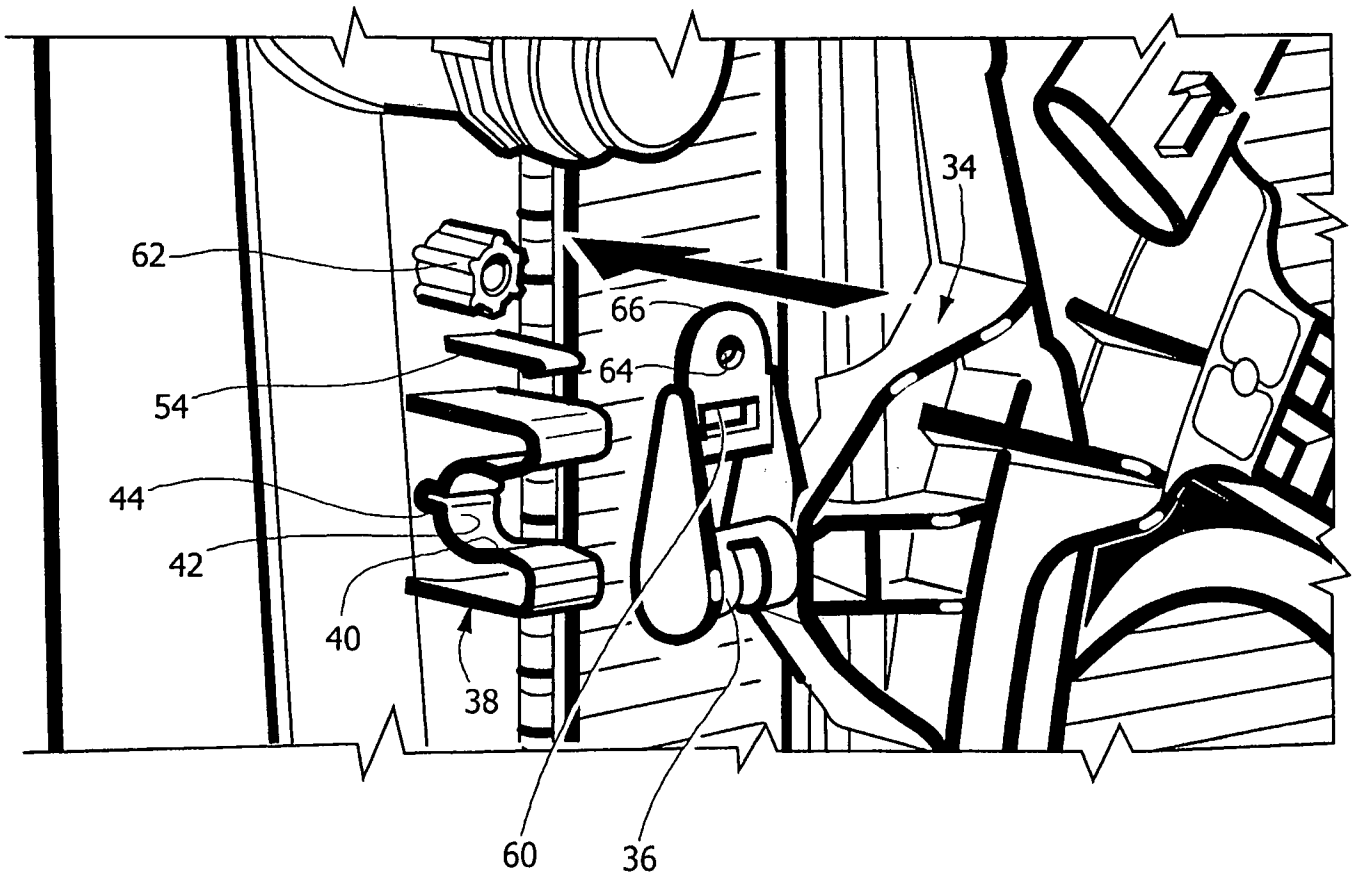

In a second embodiment illustrated in FIGS. 6, 7 and 8, the two lower seats 38 are oriented with their U-shaped opening facing upwards whilst the two upper seats are oriented with their U-shaped seat facing horizontally. In this case, the mounting of the support structure of the fan 24 is obtained engaging first the pivots of the two lower arms with the two lower seats and, subsequently, making the support structure of the fan 24 oscillate towards the radiator until bringing the two pivots of the upper arms to engage in snap-on fashion the respective upper seats, as shown in FIG. 8.

In the variant of FIGS. 6 through 8, the elements corresponding to those described above are designated by the same numeric references. The lower seat 38 is nearly identical to the lower seat described with reference to the previous embodiment, except that in this case there is no tab 54 as detent against extraction. In this variant, the tab 54 projects from the wall of the collecting tank 16, 18 (FIG. 8) and engages in snap-on fashion a slot 60 formed on an end portion of each upper arm 34. With reference to FIG. 8, in this second embodiment, each upper seat 38 is formed by a thin wall which extends according to a general M configuration, with the ends fastened to the flank of the collecting tank 16, 18 and having a U-shaped central branch 44 provided with a snap-on engagement surface 42 that cooperates with the pivot formation 36.

With reference to FIG. 8, this second variant can comprise a protuberance 62 at the upper seat 38, for the engagement by a screw engaging a hole 64 formed in a tab 66 extending from the end portion of the arm 34. The screw connection can be used alternatively or in addition to the elastic tab 54 to obtain assurance against the accidental disengagement of the support structure from the fan 24. In an additional embodiment of the present invention, the upper and lower seats could all be oriented horizontally like the seat 38 of FIG. 8.

The fastening system described above can also be used to fasten an intercooler heat exchanger to the radiator. The radiator shall be provided with snap-on engagement seats similar to those described above and the intercooler shall be provided with pivot formations similar to those provided at the ends of the arms 34 of the support structure of the fan 24.

What is claimed is:

1. Cooling assembly for vehicles, comprising:

a radiator including two collecting tanks made of plastic material, an element fastened to the radiator, and fastening means for the mutual fastening of the element and of the radiator, including two U-shaped seats on each of said collecting tanks and two pairs of engagement members fastened to said element, wherein each of said engagement members comprises a pivot formation with a cylindrical outer surface having a circular section and in that each of said seats has an elastically deformable snap-on engagement surface having a semi-cylindrical shape with the circular section able to receive said pivot formation in snap-on engagement; and at least one elastically deformable tab able to engage in snap-on fashion a planar portion that is fixed with respect to a respective engagement member.

2. Cooling assembly as claimed in claim 1, wherein each of said seats is formed by a thin wall made of plastic material extending from a wall of the respective collecting tank and comprising a U-shaped branch with an arched portion forming said snap-on engagement surface.

3. Cooling assembly as claimed in claim 1, wherein said deformable tab projects from a portion of a respective seat.

4. Cooling assembly as claimed in claim 1, wherein said elastically deformable tab projects from a wall of the respective collecting tank.

5. Cooling assembly as claimed in claim 1, wherein the seats have respective openings, all oriented in the same direction.

6. Cooling assembly as claimed in claim 1, wherein a first pair of seats has the respective openings oriented along a first direction and a second pair of seats has the respective openings oriented along a second direction, orthogonal to the first direction.

7. A cooling assembly for vehicles, comprising:

a radiator including two collecting tanks made of plastic material, an element fastened to the radiator, and fastening means for the mutual fastening of the element and of the radiator, including two U-shaped seats on each of said collecting tanks and two pairs of engagement members fastened to said element, wherein each of said engagement members comprise a pivot formation with a cylindrical outer surface having a circular section and in that each of said seats has an elastically deformable snap-on engagement surface having a semi-cylindrical shape with the circular section able to receive said pivot formation in snap-on engagement; and a first pair of seats having the respective openings oriented along a first direction and a second pair of seats having the respective openings oriented along a second direction, orthogonal to the first direction.

8. The cooling assembly as claimed in claim 7, wherein each of said seats is formed by a thin wall made of plastic material extending from a wall of the respective collecting tank and comprising a U-shaped branch with an arched portion forming said snap-on engagement surface.

9. The cooling assembly as claimed in claim 7, further comprising at least one elastically deformable tab able to engage in snap-on fashion a planar portion that is fixed with respect to a respective engagement member.

10. The cooling assembly as claimed in claim 9, wherein said deformable tab projects from a portion of a respective seat.

11. The cooling assembly as claimed in claim 9, wherein said elastically deformable tab projects from a wall of the respective collecting tank.

* * * * *